United States Patent [19]

Lorant

[11] Patent Number: 4,472,938

[45] Date of Patent: Sep. 25, 1984

[54] MULTI-CYLINDER, DOUBLE-ACTING HOT GAS ENGINE

[75] Inventor: Stefan Lorant, Oxie, Sweden

[73] Assignee: United Stirling AB, Malmo, Sweden

[21] Appl. No.: 479,470

[22] Filed: Mar. 28, 1983

[51] Int. Cl.[3] ..... F02G 1/04

[52] U.S. Cl. ..... 60/525

[58] Field of Search ..... 60/517, 524, 525, 526

[56] References Cited

U.S. PATENT DOCUMENTS

| | | | |
|---|---|---|---|
| 2,590,662 | 3/1952 | Van Weenen | 60/517 |
| 2,963,871 | 12/1960 | Meijer | 60/517 |
| 4,026,114 | 5/1977 | Belaire | 60/525 |
| 4,261,172 | 4/1981 | Bratt et al. | 60/525 |
| 4,261,173 | 4/1981 | Lorant | 60/525 |

*Primary Examiner*—Allen M. Ostrager

*Attorney, Agent, or Firm*—Finnegan, Henderson, Farabow, Garrett & Dunner

[57] ABSTRACT

In a hot gas engine the cold gas connection duct between the low temperature variable volume chamber of one cylinder and an adjacent cooler surrounding another cylinder is divided into several separate, parallel ducts leading to different segments of a chamber below said cooler.

2 Claims, 3 Drawing Figures

MULTI-CYLINDER, DOUBLE-ACTING HOT GAS ENGINE

BACKGROUND OF THE INVENTION

1. Field of the Invention

The present invention relates to a multi-cylinder, double-acting hot gas engine in which each cylinder is surrounded by an annular regenerator-cooler unit and in which a cold gas connection duct connects the end of a cooler remote from the regenerator surrounding a cylinder with a variable volume, low temperature chamber of another cylinder.

2. Description of the Prior Art

A hot gas engine of the type referred to above has been described e.g. in the U.S. Pat. No. 2,590,662. In order to obtain an evenly distributed gas flow through the annular cooler-regenerator unit it is necessary to provide a gas chamber of a substantial volume at the end of the cooler connected to the variable volume chamber of an adjacent cylinder through a duct. Although such gas chamber will have little or no influence on the efficiency of the engine it will descrease the power output and thus increase the engine cost for a desired output.

OBJECT OF THE INVENTION

The object of the present invention is to provide an improved distribution of the flow of gas through the annular regenerator cooler unit of a hot gas engine of the type referred to above while avoiding excessive dead volumes—i.e. volumes not being variable—at the low temperature section of the engine.

SUMMARY OF THE INVENTION

The object of the invention is in accordance with the invention obtained thereby that the said cold gas connecting duct consists of a plurality of parallel flow paths leading to different segments of the cooler.

DESCRIPTION OF THE PREFERRED EMBODIMENT

Figure 1:
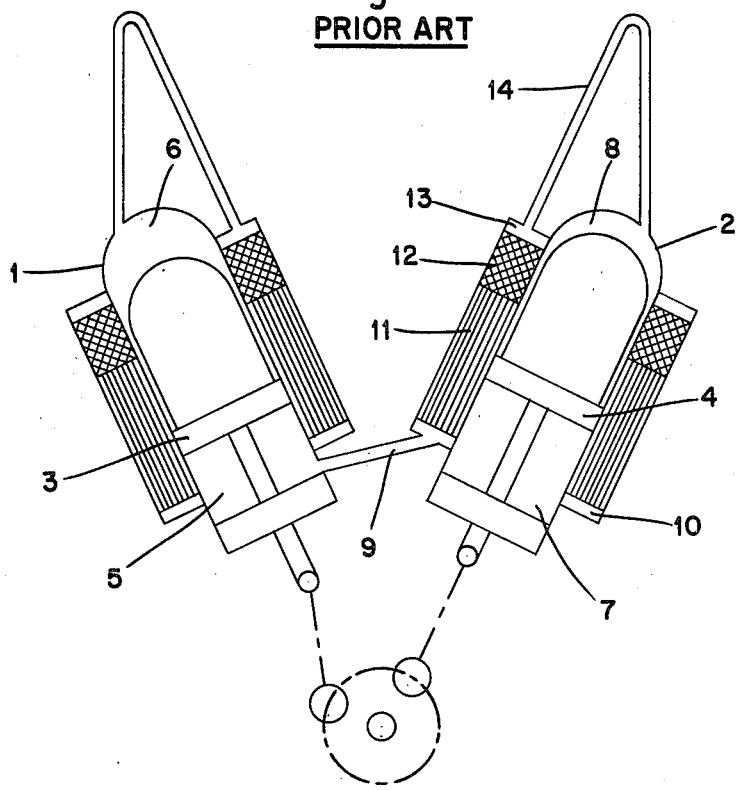
Fig. 1 PRIOR ART
FIG. 1 is a vertical section of a hot gas engine of the type described e.g. in U.S. Pat. No. 2,590,662.

Reference will now be made in detail to the preferred embodiment of the invention shown in FIGS. 2 and 3 and to the background technology shown in FIG. 1. In this latter Figure two cylinders of a hot gas engine have been designated by 1 and 2 respectively. Each cylinder 1, 2 contains a piston 3 and 4 respectively dividing the interior of the cylinders into lower and upper variable volume chambers 5, 6, 7 and 8. The lower variable volume chamber 5 of the cylinder 1 is connected to the upper variable volume chamber 8 of the cylinder 2 via a cold gas connecting duct 9 a plenum chamber 10 a cooler 11, a regenerator 12, a plenum chamber 13 and a system of heater tubes 14 (only one of which is shown). In order to obtain an even distribution of the gas flow through the cooler 11 surrounding the cylinder 2 it is necessary to design the plenum chamber 10 so as to have a substantial volume. However, as any volumes containing working gas and not being variable during the operation of the engine will cause a higher weight-power ratio it is desired to keep the volumes of the duct 9 and the plenum chamber 10 at a minimum.

Figure 2:
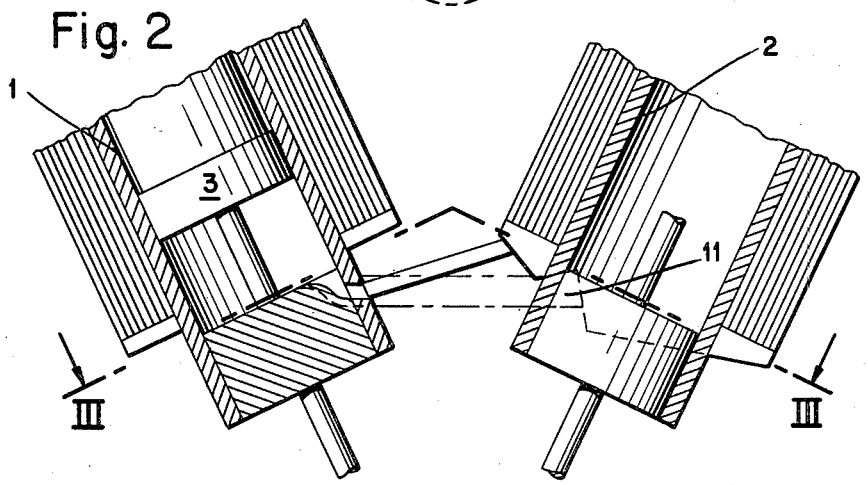
FIG. 2 is a section through the lower end of a hot gas engine according to the present invention and FIG. 3 is a section along the line III—III of FIG. 2.
Figure 3:
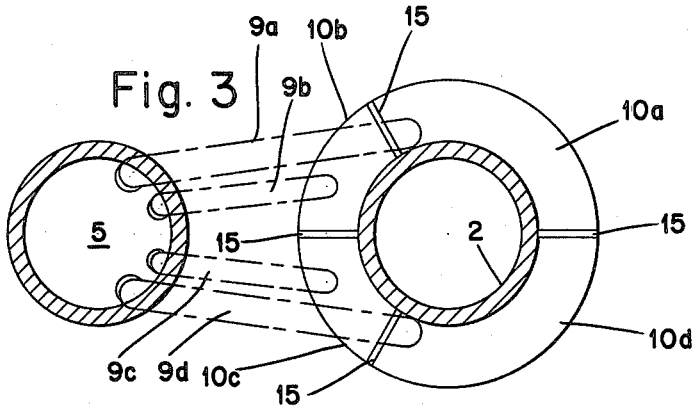

FIGS. 2 and 3 show how the cold gas connecting duct according to the invention has been divided into four parallel ducts 9*a, b, c* and *d* leading to four segments 10*a, b, c* and *d* of the plenum chamber. The longest ducts 9*a, d* are leading to plenum chamber segments 10*a, d* adjacent to cooler segments shadowed by the cylinder 2 as viewed from the variable volume chamber 5 to which they are connected. The shorter ducts 9*b* and *c* are leading to smaller segments 10*b* and *c* of the plenum chamber. The segments of the plenum chamber are separated by ridges 11.

In a hot gas engine having such size that the volume swept by each piston is 275 ccm the volume of the ducts 9*a* and *d* may be 21.6 ccm each and the volume of the ducts 9*b* and *c* 8.25 ccm each. The volume of the segments 10*a* and *d* under the cooler 11 may be 16.5 ccm each, and the volume of the segments 10*b* and *c* 5 ccm each.

I claim:

1. A multi-cylinder, double-acting hot gas engine in which each cylinder is surrounded by an annular regenerator-cooler unit and in which a cold gas connection duct connects the end of a cooler remote from the regenrator surrounding a cylinder with a variable volume, low-temperature chamber of another cylinder, characterized in that said cold gas connecting duct consists of a plurality of parallel flow paths leading to different segments of the cooler.

2. A hot gas engine as claimed in claim 1, characterized in that said flow paths are of varying length and cross sections the longest having the largest cross sections and leading to cooler segments shadowed by its central cylinder as viewed from the variable volume chamber to which they are connected.

* * * * *

UNITED STATES PATENT AND TRADEMARK OFFICE

CERTIFICATE OF CORRECTION

PATENT NO. : 4,472,938

DATED : September 25, 1984

INVENTOR(S) : Stefan Lorant

It is certified that error appears in the above-identified patent and that said Letters Patent is hereby corrected as shown below:

Column 2, line 11, insert a comma after "2";

line 16, insert a comma after "ratio";

line 29, change "11" to --15--;

line 31, insert a comma after "ccm";

delete lines 38-52 and insert:

1. In a multi-cylinder, double-acting hot gas engine in which each cylinder is surrounded by an annular regenerator-cooler unit and in which a cold gas connection duct connects the end of a cooler remote from the regenerator surrounding a cylinder with a variable volume, low-temperature chamber of another cylinder, the improvement comprising said cold gas connecting duct consisting of a plurality of parallel flow paths leading to different segments of the cooler.

UNITED STATES PATENT AND TRADEMARK OFFICE

CERTIFICATE OF CORRECTION

PATENT NO. : 4,472,938

DATED : September 25, 1984

INVENTOR(S) : Stefan Lorant

It is certified that error appears in the above-identified patent and that said Letters Patent is hereby corrected as shown below:

2. The improvement in a hot gas engine as claimed in claim 1, wherein said flow paths are of varying length and cross sections, the longest having the largest cross sections and leading to cooler segments shadowed by its central cylinder as viewed from the variable volume chamber to which them are connected.

3. The improvement in a hot gas engine as claimed in claim 1, wherein said parallel flow paths include a plurality of individual duct members.

4. The improvement in a hot gas engine as claimed in claim 1, wherein the cooler end includes plenum means for interconnecting said parallel flow paths and the cooler segments.

UNITED STATES PATENT AND TRADEMARK OFFICE

CERTIFICATE OF CORRECTION

PATENT NO. : 4,472,938

DATED : September 25, 1984

INVENTOR(S) : Stefan Lorant

It is certified that error appears in the above-identified patent and that said Letters Patent is hereby corrected as shown below:

5. The improvement in a hot gas engine as claimed in claim 4, wherein said plenum means includes a plenum chamber and a plurality of ridge members dividing said chamber into a plurality of plenum segments, each of said plenum segments cooperating with a different cooler segment.

6. The improvement in a hot gas engine as claimed in claim 5, wherein said parallel flow paths include a plurality of individual duct members, each of said duct members interconnecting the variable volume, low temperature chamber to a different one of said plenum segments.

7. The improvement in a hot gas engine as claimed in claim 6, wherein at least one of said plenum segments cooperates with a cooler segment shadowed by the respective central cylinder relative to the variable volume, low temperature chamber to which it is connected, the respective interconnecting duct member having a larger cross section than duct members interconnecting non-shadowed cooler segments.

UNITED STATES PATENT AND TRADEMARK OFFICE

CERTIFICATE OF CORRECTION

PATENT NO. : 4,472,938

DATED : September 25, 1984

INVENTOR(S) : Stefan Lorant

It is certified that error appears in the above-identified patent and that said Letters Patent is hereby corrected as shown below:

On the title page, "2 Claims, 3 Drawing Figures" should read -- 7 Claims, 3 Drawing Figures --.

Signed and Sealed this

*Seventh* Day of *May 1985*

[SEAL]

*Attest:*

DONALD J. QUIGG

*Attesting Officer* *Acting Commissioner of Patents and Trademarks*